US011846131B2

(12) United States Patent
Martinez

(10) Patent No.: US 11,846,131 B2
(45) Date of Patent: Dec. 19, 2023

(54) DOOR STATUS MONITORING SYSTEM

(71) Applicant: Jeffrey Peter Martinez, Inverness, IL (US)

(72) Inventor: Jeffrey Peter Martinez, Inverness, IL (US)

( * ) Notice: Subject to any disclaimer, the term of this patent is extended or adjusted under 35 U.S.C. 154(b) by 430 days.

(21) Appl. No.: 17/141,569

(22) Filed: Jan. 5, 2021

(65) Prior Publication Data

US 2021/0214985 A1 Jul. 15, 2021

Related U.S. Application Data

(60) Provisional application No. 62/961,535, filed on Jan. 15, 2020.

(51) Int. Cl.
*E05F 15/40* (2015.01)

(52) U.S. Cl.
CPC ..... *E05F 15/40* (2015.01); *E05Y 2400/354* (2013.01); *E05Y 2400/822* (2013.01); *E05Y 2900/106* (2013.01)

(58) Field of Classification Search
CPC ..... E05F 15/40; E05F 15/70
See application file for complete search history.

(56) References Cited

U.S. PATENT DOCUMENTS 6,011,469 A * 1/2000 Taft ..... H01H 36/0033 248/231.61
6,075,333 A * 6/2000 Huddle ..... E06B 9/82 318/266
6,166,634 A 12/2000 Dean
6,184,787 B1 2/2001 Morris
6,310,548 B1 10/2001 Stephens, Jr. et al.
6,597,291 B2 7/2003 Tsui
9,251,677 B1 * 2/2016 Mika ..... G08B 13/08
10,246,904 B1 * 4/2019 White ..... E05F 15/77
10,544,612 B1 * 1/2020 Jones ..... E05F 15/73
10,717,386 B1 * 7/2020 Holloway ..... F21V 33/006
2016/0040469 A1 * 2/2016 Lietz ..... E05F 15/70 49/31
2016/0230446 A1 8/2016 Rowe
2017/0320685 A1 * 11/2017 Hoofard ..... G06F 3/04842
2018/0114427 A1 * 4/2018 Preus ..... H04Q 9/00
2020/0141172 A1 * 5/2020 Ion ..... G07C 9/00944
2021/0363806 A1 * 11/2021 Pincher ..... E06B 9/68

* cited by examiner

*Primary Examiner* — Gregory J Strimbu
(74) *Attorney, Agent, or Firm* — PATENTFILE, LLC; Bradley C. Fach; Steven R. Kick

(57) ABSTRACT

A door status monitoring system includes a switch modulator coupled to a door and a control unit in communication with first and second display elements. A first position switch sends a first signal to the control unit when the switch modulator is proximate to the first position switch when the door is in a closed position. A second position switch sends a second signal to the control unit when the switch modulator is proximate to the second position switch when the door is in an open position. The control unit is configured to maintain the first and second display elements in a deactivated state in response to receiving the first signal, activate the first display element when the control unit is not receiving the first and second signals, and activate the second display element and deactivate the first display element in response to receiving the second signal.

8 Claims, 6 Drawing Sheets

DOOR STATUS MONITORING SYSTEM

CROSS REFERENCE TO RELATED APPLICATIONS

This application claims priority to and the benefit of the filing date of U.S. Provisional Application No. 62/961,535, filed on Jan. 15, 2020, entitled "Garage door monitor displaying red light to wait or green light safe to go.", which is hereby incorporated by reference in its entirety.

FIELD OF THE INVENTION

This patent specification relates to the field of systems configured to inform users on the status of a door. More specifically, this patent specification relates to a monitoring system configured to provide information to describing the positional status of a door.

BACKGROUND

Many types and sizes of large vehicles are moved into and out of storage buildings, such as garages. These buildings typically include a door that is movable between an open position and a closed position. Unfortunately, operators of these large vehicles may inadvertently crash the vehicle they are operating into these doors due to their inability to observe when the door is fully open, to impatience, operator error, etc. This can cause expensive and time-consuming repairs for the vehicle and/or these doors. Additionally, should the door become inoperable, the building is left open and vulnerable to the elements, theft, vandalism, and other undesirable scenarios.

Therefore, a need exists for novel systems which are able to monitor and provide information describing the positional status of a door. A further need exists for novel door monitoring systems that are capable of monitoring any type of door, including those with or without a garage door opener.

BRIEF SUMMARY OF THE INVENTION

A door status monitoring system is provided which may be configured to display the positional status of a door that is movable between a closed position and an open position. In some embodiments, the device may include a control unit that may be in communication with a first display element and a second display element. Preferably, the display elements may be integrated into or otherwise coupled to a display unit. A switch modulator may be coupled to the door. A first position switch may be in communication with the control unit. The switch modulator may be proximate to the first position switch when the door is in the closed position. The first position switch may send a first signal to the control unit when the first position switch detects that the switch modulator is proximate to it, and the control unit may maintain the first and second display elements in a deactivated state in response to receiving the first signal. A second position switch may also be in communication with the control unit. The switch modulator may be proximate to the second position switch when the door is in the open position. The second position switch may send a second signal to the control unit when the second position switch detects that the switch modulator is proximate to it. The control unit may activate the first display element when it is not receiving the first and second signals, and the control unit, in response to receiving the second signal, may activate the second display element and deactivate the first display element. Preferably, by observing the display elements of the control unit, a user may determine the positional status of the door, such as if it is in or between the closed and open positions.

In further embodiments, the system may include a display unit, and the first display element and second display element both coupled to the display unit.

In further embodiments, the first display element is configured to flash when activated.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
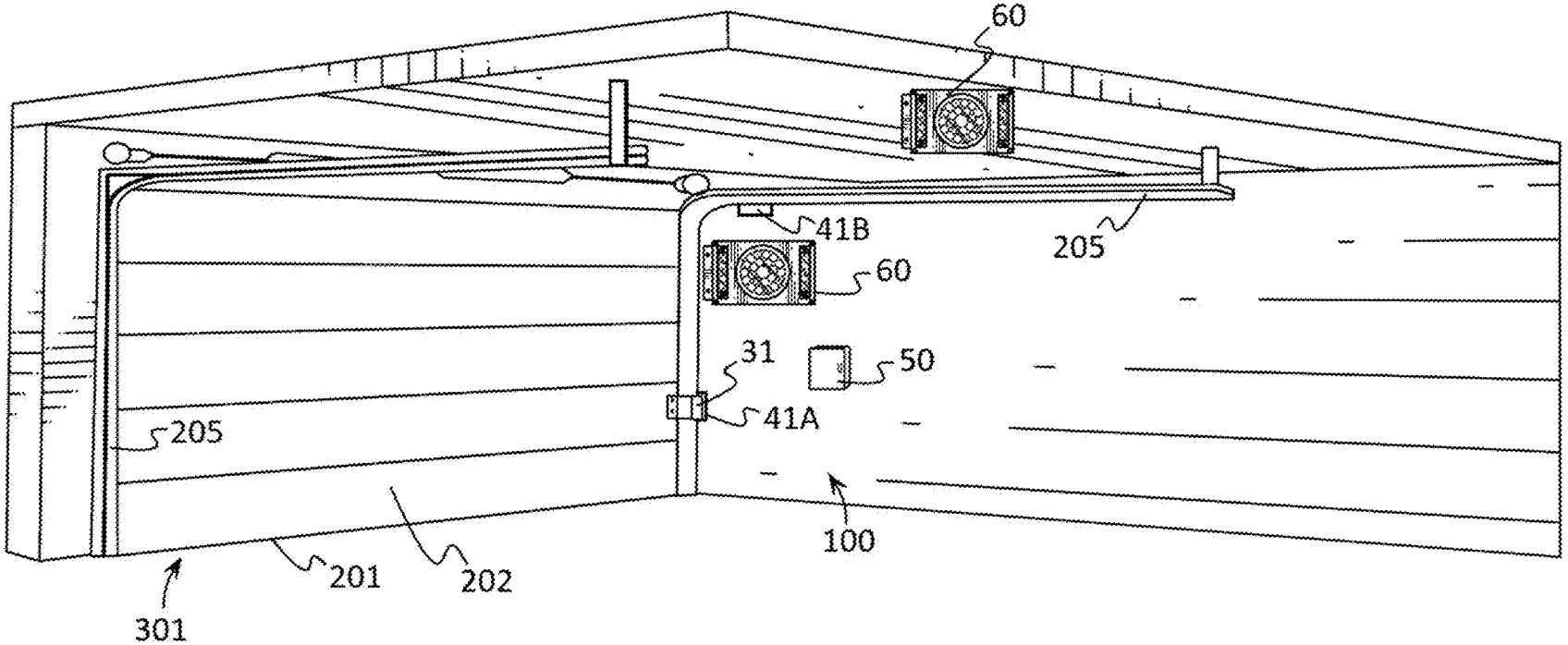
FIG. 1 depicts a perspective view of an example of a door status monitoring system with a door in a closed position according to various embodiments described herein.

For purposes of description herein, the terms "upper," "lower," "left," "right," "rear," "front," "side," "vertical," "horizontal," and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first," "second," etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within about 10% of the actual desired value, particularly within about 5% of the actual desired value and especially within about 1% of the actual desired value of any variable, element or limit set forth herein.

A new door status monitoring system is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

Figure 2:
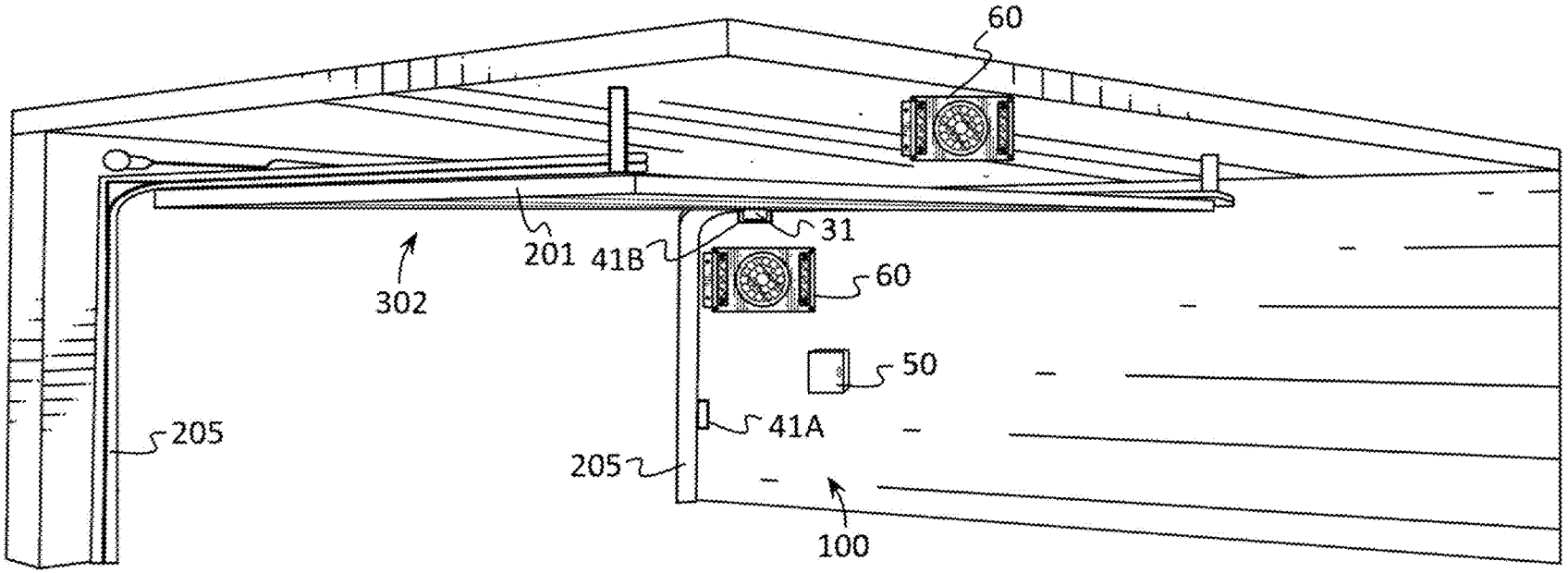
FIG. 2 illustrates a perspective view of an example of a door status monitoring system with a door in an open position according to various embodiments described herein.
Figure 7:
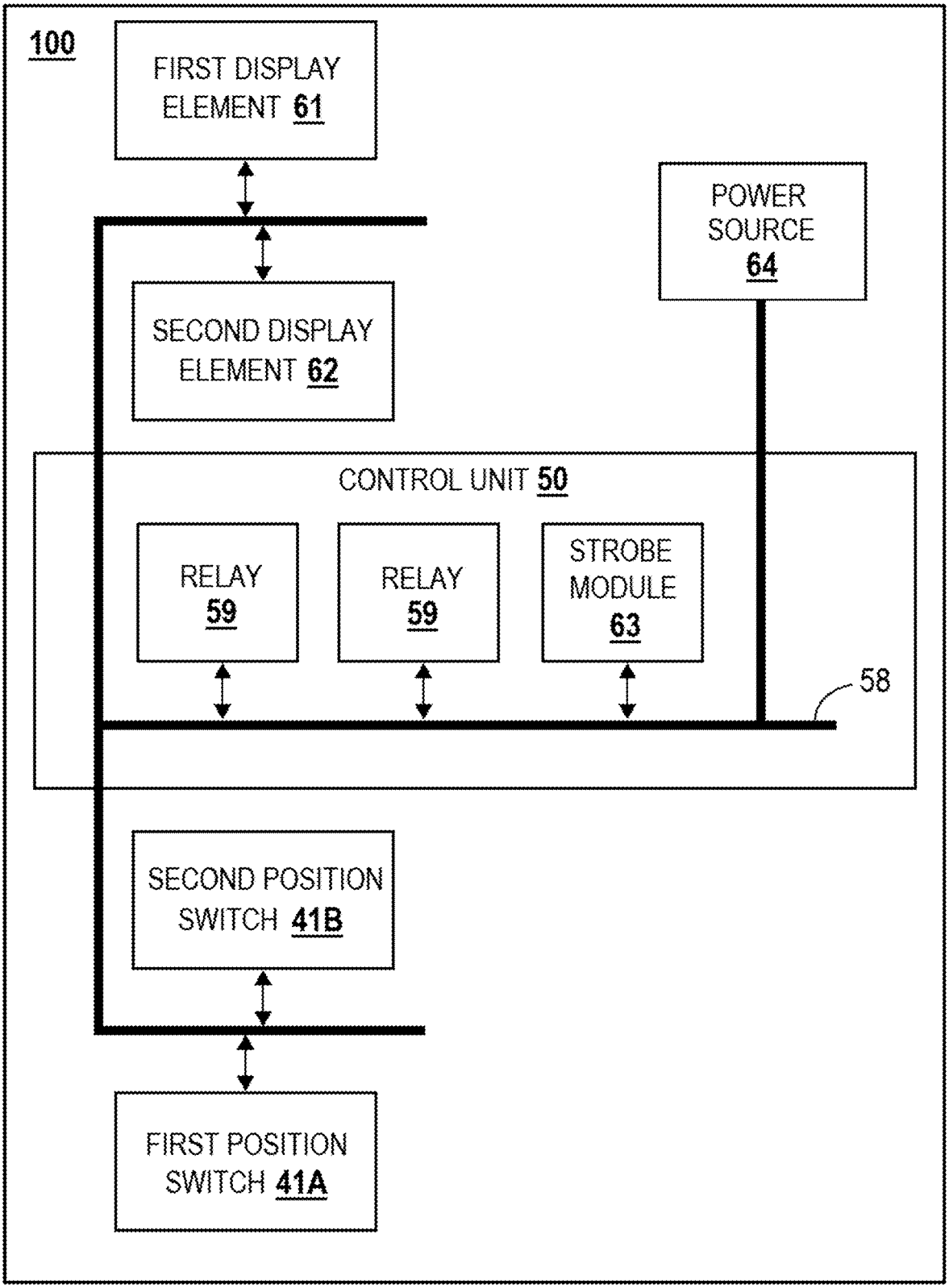
FIG. 7 depicts a block diagram of an example of a door status monitoring system utilizing wired communication between elements according to various embodiments described herein.

The present invention will now be described by example and through referencing the appended figures representing preferred and alternative embodiments. FIGS. 1, 2, and 7 illustrate examples of a door status monitoring system ("the system") 100 according to various embodiments. The system 100 may be configured to display the positional status of a door 201 that is movable between a closed position 301 and an open position 302. In some embodiments, the device 100 may comprise a control unit 50 that may be in communication with a first display element 61 and a second display element 62. Preferably, the display elements 61, 62, may be integrated into or otherwise coupled to a display unit 60. A switch modulator 31 may be coupled to the door 201. A first position switch 41A may be in communication with the control unit 50. The switch modulator 31 may be proximate to the first position switch 41A when the door 201 is in the closed position 301. The first position switch 41A may send a first signal to the control unit 50 when the first position switch 41A detects that the switch modulator 31 is proximate to it, and the control unit 50 may maintain the first display element 61 and second display element 62 in a deactivated state in response to receiving the first signal. A second position switch 41B may also be in communication with the control unit 50. The switch modulator may be proximate to the second position switch 41B when the door 201 is in the open position 302. The second position switch 41B may send a second signal to the control unit 50 when the second position switch 41B detects that the switch modulator 31 is proximate to it. The control unit 50 may activate the first display element 61 when it is not receiving the first and second signals, and the control unit 50, in response to receiving the second signal, may activate the second display element 62 and deactivate the first display element 61. Preferably, by observing the display elements 61, 62, of the control unit 50, a user may determine the positional status of the door 201, such as if it is in or between the closed 301 and open 302 positions.

The system 100 may be used with any type of door 201 that may be moved into and between a closed position 301 and an open position 302. Generally, a closed position 301 may define a positioning of the door 201 that prevents access to the opening that the door 201 is governing, and an open position 302 may define a positioning of the door 201 that grants an amount of access to the opening that the door 201 is governing that is sufficient to allow a desired object, such as a vehicle, person, etc., to pass through the opening without contacting the door 201. In preferred embodiments, an open position 302 may define a positioning of the door 201 that grants the most access to the opening that the door 201 is governing.

In preferred embodiments, the system 100 may be used with a garage door type of door 201. A garage door is a large door on a garage or storage building that opens either manually or by an electric motor (a garage door opener). Garage doors are frequently large enough to accommodate automobiles and other vehicles. Small garage doors may be made in a single panel that tilts up and back across the garage ceiling. Larger doors are usually made in several jointed panels that roll up on tracks across the garage ceiling, or into a roll above the doorway. The operating mechanism is spring-loaded or counterbalanced to offset the weight of the door and reduce human or motor effort required to operate the door. Less commonly, some garage doors slide or swing horizontally. Doors are made of wood, metal, or fiberglass, and may be insulated to prevent heat loss. Warehouses, bus garages and locomotive sheds have larger versions. It should be understood that the system 100 may be used with any type of door 201, including those with (automatically operated) or without (manually operated) a garage door opener.

Figure 6:
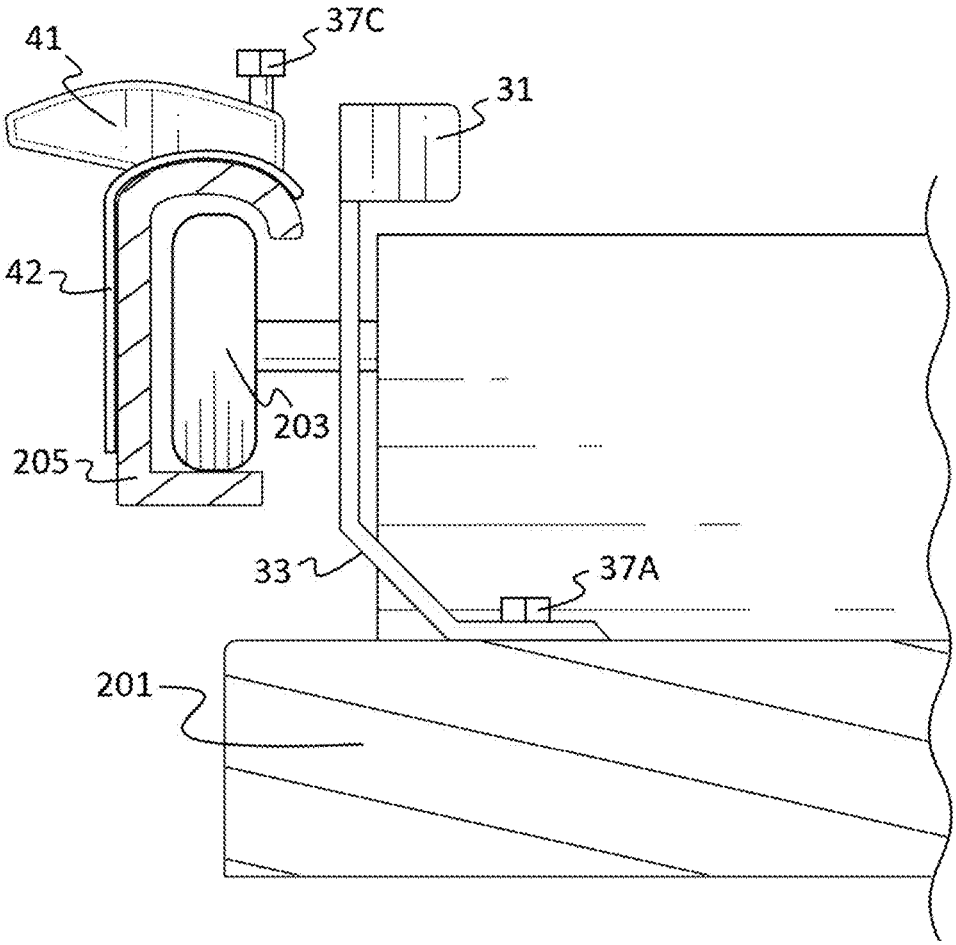
FIG. 6 shows a sectional, elevation view of an example of a position sensor and switch modulator in use with a door according to various embodiments described herein.

In preferred embodiments, the system 100 may be used with a type of door 201 that moves on one or more tracks 205 into and between a closed position 301 and an open position 302. For example, the system 100 may be used with a door 201 having a number of sections 202 and each section 202 may be movably coupled to two tracks 205 that are positioned on opposing sides of the door 201 via one or more rollers 203 which may be engaged to a respective track 205 as best shown in FIG. 6.

The system 100 may comprise one or more position switches 41, such as a first position switch 41A, a second position switch 41B, a third position switch, a fourth position switch, a fifth position switch, a sixth position switch, a seventh position switch, etc. Generally, a position switch 41A, 41B, may be configured to detect the position of a switch modulator 31 and to provide a signal describing detection and/or lack of detection of the switch modulator 31 to the control unit 50.

In some embodiments, a position switch 41A, 41B, may be configured to detect the position of a switch modulator 31 by detecting if the switch modulator 31 is proximate to the position switch 41A, 41B, via magnetic interaction. In this manner, a first position switch 41A may detect that the switch modulator 31 is proximate to it via magnetic interaction between the first position switch 41A and the switch modulator 31, and a second position switch 41B may detect that the switch modulator 31 is proximate to it via magnetic interaction between the second position switch 41B and the switch modulator 31.

In preferred embodiments, a switch modulator 31 may comprise a magnetic material 32, and a position switch 41A, 41B, may comprise a Hall-effect sensor or Hall sensor that is combined with threshold detection, so that the position switch 41A, 41B, acts as a switch. In alternative embodiments, position switch 41A, 41B, may comprise a magnetic material 32, and a switch modulator 31 may comprise a Hall-effect sensor or Hall sensor that is combined with threshold detection, so that the switch modulator 31 acts as a switch.

In some embodiments, a magnetic material 32 may be or may comprise a high-coercivity ferromagnetic compound type of magnetic material such as ferric oxide mixed with a plastic binder. In other embodiments, a magnetic material 32 may be or may comprise ferrite, manganese-zinc ferrite, nickel-zinc ferrite, strontium ferrite, cobalt ferrite, barium ferrite, magnetic alloys such as alnico, comol, Hypernom® magnetic alloy, manganese-zinc ferrite, iron-silicon magnet alloys, nickel-zinc ferrite, ferritic stainless steel alloys, strontium ferrite, barium ferrite, alnico, iron-silicon magnet alloy, Chromindur® (Chromium-Cobalt-Iron) alloys, Silmanal (Silver-Manganese-Aluminium) alloys, Platinax II (platinum-cobalt) alloy, Bismanol (manganese bismuthide) alloy, cobalt-platinum alloys, chromium-manganese antimonide alloy, vectolite (cobalt ferrite), magnadur (sintered barium ferrite), lodex (oxide-coated iron-cobalt particles), awaruite ($Ni_2Fe$ to $Ni_3Fe$ nickel-iron alloy), wairauite, rare earth magnets such as samarium-cobalt, cesium-cobalt, neodymium-iron-boron, other neodymium magnet materials, metallic oxides such as magnetite, ulvospinel, hematite, ilmenite, maghemite, jacobsite, iron sulfides such as pyrrhotite, greigite, troilite, metallic oxyhydroxides such as goethite, lepidocrocite, feroxyhyte, ferrimagnetic materials such as magnetite, pyrrhotite, cubic ferrites, hexagonal ferrites, ferromagnetic materials including metals such as iron, nickel, cobalt, metal alloys containing iron, nickel, and/or cobalt, soft magnetic materials, hard magnetic materials, or any other suitable magnetic material, that is capable of magnetically adhering to another magnetic material through the principle of magnetism. In further embodiments, a magnetic material 32 may comprise an electromagnet or any other object or device capable of generating a magnetic field.

In further embodiments, a switch modulator 31 and/or a position switch 41A, 41B, may comprise a moment switch, detent switch, single pole switch, electric eye, Hall effect sensor, pressure switch, electrical circuit, a reed switch, a contact sensor, a button mount, an ambient light sensor, Capacitive transducer, Capacitive displacement sensor, Eddy-current sensor, Ultrasonic sensor, Grating sensor, Inductive non-contact position sensors, Laser Doppler Vibrometer (optical), Linear variable differential transformer (LVDT), Multi-axis displacement transducer, Photodiode array, Piezo-electric transducer (piezo-electric), Potentiometer, Proximity sensor (optical), Rotary encoder (angular), Seismic displacement pick-up, String potentiometer (also known as string pot, string encoder, cable position transducer), or any other suitable sensor or device which may be able to detect if a switch modulator 31 is proximate, so as to be detectable, to a position switch 41A, 41B, and to provide a signal describing detection and/or lack of detection of the switch modulator 31 to the control unit 50.

In preferred embodiments, a switch modulator 31 may comprise a magnetic material 32 which may be coupled to a modulator bracket 33 and the modulator bracket 33 may be configured or used to couple the magnetic material 32 to a door 201. In alternative embodiments, a modulator bracket 33 may be configured or used to couple the magnetic material 32 to a track 205. Generally, a modulator bracket 33 may comprise a bracket formed of a structural material, such as steel, aluminum, plastic, etc., which may be shaped to position a magnetic material 32 a desired distance from a desired position switch 41A, 41B, when the door 201 is in a desired position 301, 302. For example, a modulator bracket 33 may comprise a first panel 34, a second or middle panel 35, and a third panel 36 which may be angled, such as approximately 45 degrees, relative to each other. A magnetic material 32 may be coupled to the first panel 34 and the second 35 and/or third 36 panel may be coupled to the door 201 via one or more fasteners 37A and fastener apertures 38. Preferably, a modulator bracket 33 may be used to couple a switch modulator 31 to any desired position on a door 201 that is preferably proximate to a track 205 that the door 201 may be coupled to.

In preferred embodiments, the system 100 may comprise a switch bracket 42 and the switch bracket 42 may be configured or used to couple a position switch 41A, 41B, to a track 205. In alternative embodiments, a switch bracket 42 may be configured or used to couple a position switch 41A, 41B, to a door 201. Generally, a switch bracket 42 may comprise a bracket formed of a structural material, such as steel, aluminum, plastic, etc., which may be shaped to position a position switch 41A, 41B, a desired distance from a desired position switch modulator 31 when the door 201 is in a desired position 301, 302. For example, a switch bracket 42 may comprise a first panel 43 and a second panel 44 which may be angled, such as approximately 90 degrees, relative to each other, such as an angle bracket. Electronic components, such as a magnetic sensor or Hall sensor, may be coupled to the first panel 43 optionally via one or more fasteners 37B and the second panel 44 may be coupled to a track 205 or other structure proximate to the door 201 via one or more fasteners 37C. Preferably, a switch bracket 42 may be used to couple a position switch 41A, 41B, to any desired position on or proximate to a track 205 that the door 201 may be coupled to.

While in some embodiments, the one or more switch modulator(s) 31 and position switches 41A, 41B, may be mounted on a door 201 and any other structure proximate to the door 201, such as a track 205, in preferred embodiments, system 100 may be used with a door 201 that moves on a track 205 and the system 100 may comprise a first position switch 41A and a second position switch 41B that are each coupled to the track 205. For example, a first position switch 41A may be coupled to a portion of a track 205 on the right side of a door 201 approximately 30 inches off the ground. A switch modulator 31 may be coupled to the door 201 while the door is in a closed position 301 so that it is proximate to the first position switch 41A, such as by also being positioned approximately 30 inches off the ground and approximately less than 5 inches away from the first position switch 41A on the right side of the door 201. Next, the door 201 may be moved into the open position 302, and the second position switch 41B may be coupled to a portion of the track 205 on the right side of the door 201 approximately less than 5 inches away from the switch modulator 31. In this manner, when the door 201 is in the closed position 301, the first position switch 41A may detect the switch modulator 31 and the first position switch 41A may send a first signal to the control unit 50. Likewise, when the door 201 is in the open position 302, the second position switch 41B may detect the switch modulator 31 and the second position switch 41B may send a second signal to the control unit 50.

When describing the positioning of the position switches 41A, 41B, and switch modulator 31, the term "proximate" may describe a separation distance in which the position switches 41A, 41B, are configured to detect a switch modulator 31. For position switches 41A, 41B, and switch modulators 31 operating via magnetic interaction, the strength of the magnetic field of a magnetic material 32 may dictate the separation distance referred to by "proximate". For commonly used magnetic materials 32, the term "proximate" typically refers to being less than 5 inches apart, and more preferably between approximately 1 and 2 inches apart. However, stronger magnetic materials 32 may still be proximate by being less than 10 inches apart.

In some embodiments, the system 100 may comprise one or more display elements 61, 62. In preferred embodiments, the system 100 may comprise a first display element 61 and a second display element 62. Generally, a display element 61, 62, may be operable by a control unit 50 to generate or output one or more colors, and optionally intensities, of light. A display element 61, 62, may be operable by a control unit 50 to be activated or deactivated. When activated (in an activated state) a display element 61, 62, may generate or output one or more colors, and optionally intensities, of light. When deactivated (in a deactivated state) a display element 61, 62, may not generate or output light.

In some embodiments, a display element 61, 62, may comprise one or more light emitting diodes (LEDs) which may be configured to provide light of various wavelengths and intensities when the display element 61, 62, is activated. For example, a display element 61, 62, may comprise a number of LEDs which may be illuminated when the display element 61, 62, is activated. In further embodiments, a display element 61, 62, may comprise one or more of an organic light-emitting diode (OLED), incandescent light bulb, fluorescent light, bulb halogen light bulb, high-intensity discharge light bulb, electroluminescent light source, neon light source, light strip, Liquid crystal display (LCD), Light-emitting diode display (LED), Electroluminescent display (ELD), Electronic paper, E Ink, Plasma display panel (PDP), Cathode ray tube display (CRT), High-Performance Addressing display (HPA), Thin-film transistor display (TFT), Organic light-emitting diode display (OLED), Surface-conduction electron-emitter display (SED), Laser TV, Carbon nanotubes, Quantum dot display, Interferometric modulator display (IMOD), and/or any other device or method which may be configured to generate or output illumination of one or more colors when activated.

In some embodiments, the system 100 may comprise one or more standalone display elements 61, 62, which may be positioned remotely from one or more other display elements 61, 62, a control unit 50, and/or other elements of the system 100. In preferred embodiments, the system 100 may comprise one or more display units 60, and one or more display elements 61, 62, may be integrated or coupled to each display unit 60. A display unit 60 may provide an enclosure or housing for the display elements 61, 62, a control unit 50, and/or other elements of the system 100. A display unit 60 may be configured in any size and shape. For example, a display unit 60 may include a waterproof plastic, metal, or other structural material case that may surround and protect the one or more electrical components, such as one or more display elements 61, 62, of the display unit 60 from dirt, water, and other contaminants. Preferably, each display unit 60 of the system 100 may each comprise at least one first display element 61 and at least one second display element 62, and the control unit 50 may activate and deactivate each first display element 61 in the same manner and likewise activate and deactivate each second display element 62 in the same manner. In this manner, each display unit 60 may generate the same illumination/non-illumination output as the other display units 60 of a multi-display unit 60 system 100.

Figure 3:
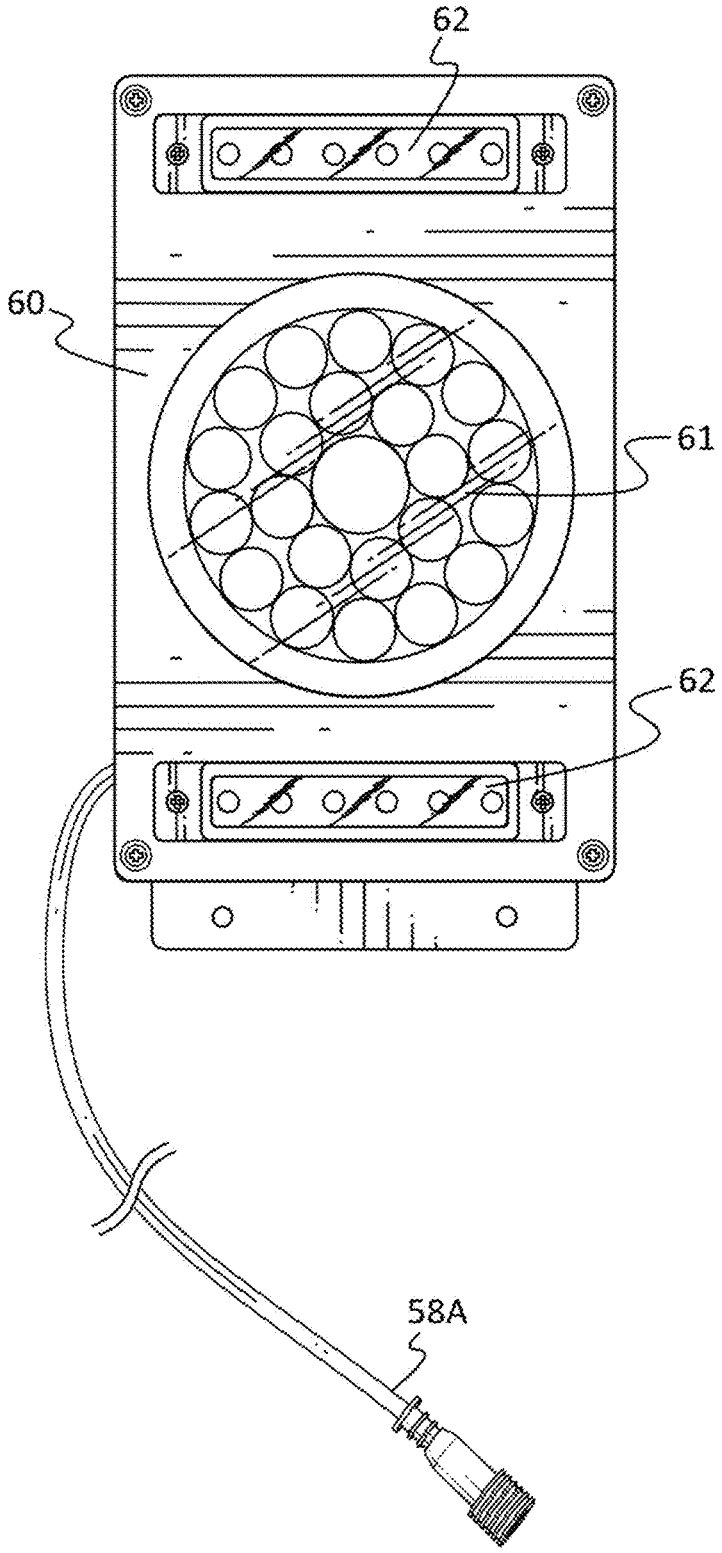
FIG. 3 shows a perspective view of an example of a display unit according to various embodiments described herein.
Figure 4:
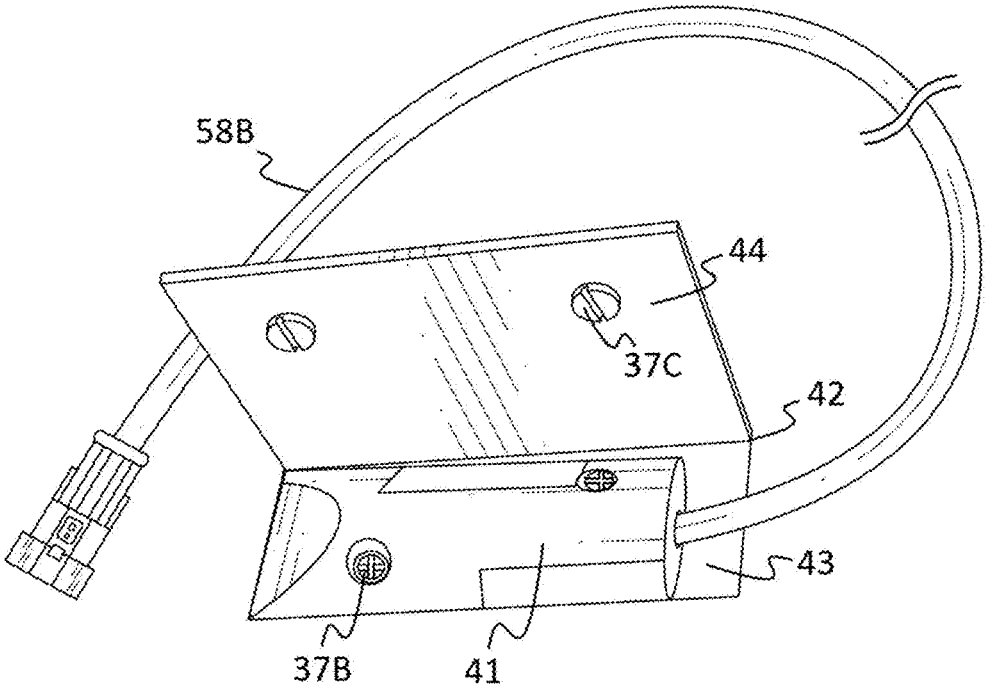
FIG. 4 depicts a perspective view of an example of a position switch according to various embodiments described herein.
Figure 5:
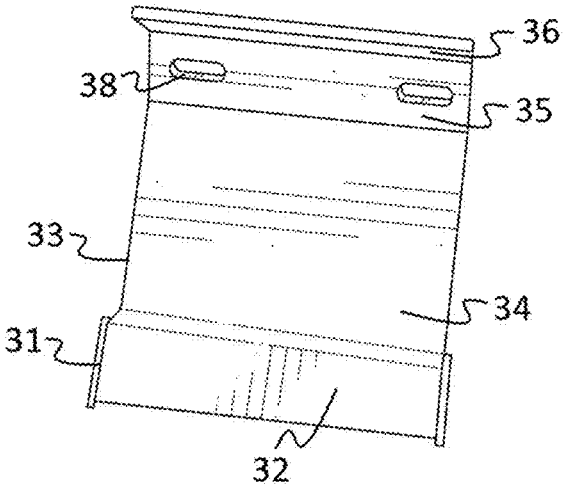
FIG. 5 illustrates a perspective view of an example of a switch modulator according to various embodiments described herein.

Optionally, a display unit 60 may comprise duplicates or multiples of one or more display elements 61, 62. For example, and as best shown in FIG. 3, a display unit 60 may comprise two second display elements 62 positioned on opposite sides of a first display element 61. However, it should be understood that a display element 61, 62, may be configured in any size and shape and that a display element 61, 62, may be positioned anywhere on a display unit 60.

The display elements 61, 62, and position switches 41A, 41B, may be in electronic communication with a control unit 50 so that the control unit 50 may operate the display elements 61, 62, based on signals that may be communicated to it by the position switches 41A, 41B. In some embodiments, one or more of the display elements 61, 62, and/or position switches 41A, 41B, may be in wired communication with a control unit 50 via one or more wired local interfaces 58A, 58B, such as wiring harnesses, wires, or other physical interface as shown in FIG. 7.

The system 100 may comprise a control unit 50 that may be configured in any size and shape and with any suitable components which may be configured to enable the control unit 50 to operate the display elements 61, 62, based on signals that may be communicated to it by the position switches 41A, 41B. For example, a control unit 50 may include a waterproof plastic, metal, or other structural material case that may surround and protect the one or more electrical components of the control unit 50 from dirt, water, and other contaminants.

In some embodiments, and as shown in FIG. 7, the control unit 50 may comprise one or more relays 59 and preferably two or more relays 59 which may be configured to operate the display elements 61, 62, based on signals that may be communicated to the relays 59 or other type of power routing switches by the position switches 41A, 41B. Relays 59 are electric switches that use electromagnetism to convert small electrical stimuli into larger currents. These conversions occur when electrical inputs activate electromagnets to either form or break existing circuits. In further embodiments, a control unit 50 may include one or more specific circuits (e.g., application specific integrated circuits (ASICs)) which may be configured to operate the display elements 61, 62, based on signals that may be communicated to the specific circuits by the position switches 41A, 41B.

Optionally, the system 100 may include or be in communication with a power source 64 which may provide electrical power to one or more components. A power source 64 may comprise a battery, such as a lithium-ion battery, nickel cadmium battery, alkaline battery, or any other suitable type of battery, a fuel cell, a capacitor, a super capacitor, or any other type of energy storing and/or electricity releasing device. In further embodiments, a power source 64 may comprise a power cord, kinetic or piezo electric battery charging device, a solar cell or photovoltaic cell, and/or inductive charging or wireless power receiver. In further embodiments, a power source 64 may comprise a power charging and distribution module which may be configured to control the recharging of the power source 64, discharging of the power source 64, and/or distribution of power to one or more components of the system 100 that may require electrical power.

Generally, a control unit 50 may be configured to activate and deactivate one or more display elements 61, 62, in response to receiving and/or not receiving a signal from one or more position switches 41A, 41B.

In some embodiments, the control unit 50 may not activate (maintain in a deactivated state) the one or more first display elements 61 and the one or more second display elements 62 when the control unit 50 is receiving a first signal from a first position switch 41A. In further embodiments, the control unit 50 may activate a first display element 61 so that the first display element 61 generates or outputs one or more colors of light (such as substantially red light) in response to not receiving a signal from a first position switch 41A and not receiving a signal from a second position switch 41B. In further embodiments, the control unit 50 may activate one or more second display elements 62 so that the second display elements 62 generate or output one or more colors of light (such as substantially green light) in response to receiving a second signal from a second position switch 41B, and the control unit 50 may also deactivate the one or more first display elements 61 so that the first display elements 61 do not generate or output light in response to the control unit 50 receiving a second signal from a second position switch 41B.

In preferred embodiments of the system 100, a first display element 61 may be operable by the control unit 50 to output a first color of light, such as red, in response to the control unit 50 either receiving no signal from a first position switch 41A and second position switch 41B or alternatively receiving a first signal from a first position switch 41A, and a second display element 62 may be operable by the control unit 50 to output a second color of light, such as green, in response to the control unit 50 receiving a second signal from a second position switch 41B in which the first color of light is a different color than the second color of light. Generally, red light may have a wavelength approximately between 625-700 nm and a frequency approximately between 400-480 THz, while green light may have a wavelength approximately between 500-565 nm and a frequency approximately between 530-600 THz. In preferred embodiments, a first display element 61 may be operable by the control unit 50 to substantially output (greater than 95 percent) red light in response to the control unit 50 receiving a first signal from a first position switch 41A, and a second display element 62 may be operable by the control unit 50 to substantially output (greater than 95 percent) green light in response to the control unit 50 receiving a second signal from a second position switch 41B.

In some embodiments, the control unit 50 may be configured to keep the first display element activated 61 when it is not receiving a first signal from a first position switch 41A and when it is not receiving a second signal from a second position switch 41B. In further embodiments, the control unit may be configured to de-activate (turn off) the first display element 61 in response to receiving a signal from a second position switch 41B.

Optionally, a display element 61, 62, may flash (alternate between generating illumination and not generating illumination, such as by alternating between generating illumination for approximately two or less seconds and not generating illumination for approximately two or less seconds) when activated. In preferred embodiments, a first display element 61 may be configured to flash red light when activated.

In some embodiments, a control unit 50 may alternate the supply of power to a display element 61, 62, to cause it to flash. In further embodiments, the system 100 may comprise one or more strobe modules 63 or flashers which may be configured to may alternate the supply of power to a display element 61, 62, to cause it to flash. Optionally, a strobe module 63 may be integrated with a relay 59 as a flasher relay. In further embodiments, any suitable device or method of causing a display element 61, 62, to flash may be used by the system 100.

While some exemplary shapes and sizes have been provided for elements of the system 100, it should be understood to one of ordinary skill in the art that the control unit 50, position switches 41, switch modulators 31 display units 60, and any other element described herein may be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

Additionally, while some materials have been provided, in other embodiments, the elements that comprise the system 100 may be made from or may comprise durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or may comprise durable and slightly flexible materials such as soft plastics, silicone, soft rubbers, or any other suitable materials including combinations of materials. In some embodiments, one or more of the elements that comprise the system 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the system 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, a slide-to-lock type connection method or any other suitable temporary connection method as one reasonably skilled in the art could envision to serve the same function. In further embodiments, one or more of the elements that comprise the system 100 may be coupled by being one of connected to and integrally formed with another element of the system 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A door status monitoring system for displaying a positional status of a door for an opening, the door movable between a closed position covering the opening and an open position, the system comprising:

a display unit, wherein a first display element and a second display element are both mounted to the display unit;

a control unit in communication with the first display element and the second display element;

a switch modulator coupled to the door via a modulator bracket;

wherein the modulator bracket comprises a first modulator bracket panel, a second modulator bracket panel, and a third modulator bracket panel, wherein the first modulator bracket panel is angled approximately 45 degrees relative to the second modulator bracket panel, and wherein the second modulator bracket panel is angled approximately 45 degrees relative to the third modulator bracket panel;

a first position switch in communication with the control unit, wherein the door moves on a track, wherein the first position switch is mounted to the track via a switch bracket, wherein the switch modulator is proximate to the first position switch when the door is in the closed position, wherein the first position switch sends a first signal to the control unit when the first position switch detects that the switch modulator is proximate to the first position switch, and wherein the control unit maintains the first and second display elements in a deactivated state in response to receiving the first signal when the door is in the closed position;

a second position switch in communication with the control unit and mounted to the track, wherein the switch modulator is proximate to the second position switch when the door is in the open position, the open position defining a position of the door that grants the most access to the opening, wherein the second position switch sends a second signal to the control unit when the second position switch detects that the switch modulator is proximate to the second position switch, wherein the control unit continuously activates the first display element in response to the control unit not receiving the first and second signals when the door is between the closed position and the open position, wherein the first display element flashes when activated, and wherein the control unit, in response to receiving the second signal when the door is in the open position, activates the second display element and deactivates the first display element.

2. The system of claim 1, wherein the control unit operates the first display element to output a first color of light when the control unit receives no signal from the first position switch and the second position switch, wherein the control unit operates the second display element to output a second color of light in response to the control unit receiving the second signal from the second position switch, and wherein the first color of light is a different color than the second color of light.

3. The system of claim 2, wherein the first color of light is substantially red and the second color of light is substantially green.

4. The system of claim 1, wherein the switch modulator comprises a magnetic material.

5. The system of claim 4, wherein the first position switch detects that the switch modulator is proximate to the first position switch via magnetic interaction between the first position switch and the switch modulator.

6. The system of claim 4, wherein the second position switch detects that the switch modulator is proximate to the second position switch via magnetic interaction between the second position switch and the switch modulator.

7. The system of claim 1, wherein one of the first position switch and the second position switch is in wired communication with the control unit.

8. The system of claim 1, wherein the switch bracket comprises a first switch bracket panel and a second switch bracket panel, wherein the first switch bracket panel is angled approximately 90 degrees relative to the second switch bracket panel.

* * * * *